US006585436B2

(12) United States Patent
Kurashina

(10) Patent No.: US 6,585,436 B2
(45) Date of Patent: Jul. 1, 2003

(54) PRINTING METHOD AND APPARATUS AND LABEL-PRODUCING METHOD AND APPARATUS

(75) Inventor: Hiroyasu Kurashina, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/782,526

(22) Filed: Feb. 13, 2001

(65) Prior Publication Data

US 2001/0041087 A1 Nov. 15, 2001

(30) Foreign Application Priority Data

Mar. 21, 2000 (JP) ..... 2000-077680

(51) Int. Cl.[7] ..... B41J 11/28; B41J 5/30; B41J 3/42

(52) U.S. Cl. ..... 400/615.2; 400/61; 400/70; 400/76; 400/103; 400/104

(58) Field of Search ..... 400/615.2, 103, 400/76, 70, 61, 104

(56) References Cited

U.S. PATENT DOCUMENTS 5,586,036 A * 12/1996 Pintsov ..... 380/51
5,712,916 A * 1/1998 Windel et al. ..... 380/51

FOREIGN PATENT DOCUMENTS

| | | | |
|---|---|---|---|
| JP | 59-197993 | 11/1984 | |
| JP | 61-000384 | 1/1986 | |
| JP | 1-127046 | 5/1989 | |
| JP | 6-285210 | 10/1994 | |
| JP | 11196306 A * | 7/1999 | ..... H04N/5/225 |
| JP | 11268354 A * | 10/1999 | ..... B41J/5/30 |

OTHER PUBLICATIONS

English translation of JP 11196306 A.*

Computer Translation of JP 11–268354A to Watanabe et al published Oct. 1999 translated Mar. 2002.*

* cited by examiner

*Primary Examiner*—Charles H. Nolan, Jr.
(74) *Attorney, Agent, or Firm*—Hogan & Hartson, LLP

(57) ABSTRACT

There are provided a printing method and apparatus as well as provide a label-producing method and apparatus that are capable of adding an amusing effect and topicality resulting therefrom to printing personally performed by a user. A predetermined print instruction is issued to print a desired image entered intentionally, on a printing medium. When the predetermined print instruction is issued, the desired image is printed, and if a predetermined condition which cannot be intentionally set by an instruction of a user is satisfied at the same time, an unintended image which cannot be generated intentionally is also printed together with the desired image.

22 Claims, 9 Drawing Sheets

PRINTING METHOD AND APPARATUS AND LABEL-PRODUCING METHOD AND APPARATUS

BACKGROUND OF THE INVENTION

1. Field of the Invention

This invention relates to a printing method and apparatus, and also relates to a label-producing method and apparatus.

2. Prior Art

In general, a printing apparatus is intended for use in printing desired images, such as desired character string images, as desired. That is, the object of a printing operation performed by the printing apparatus is to print a desired image as desired.

However, operations for inputting, editing and printing e.g. stereotyped character strings often bore a user. Unexpected results of printing occasionally caused by erroneous editing or the like may happen to amuse the user, but such erroneous operations naturally decrease as the user learns more about the printing apparatus and word processor software and the like that operate on the printing apparatus. Further, pleasure found in operating various functions thereof on a trial basis is specifically for beginners.

On the other hand, an apparatus intended for outputting results of lottery or fortune-telling can be used for a game or the like as well. However, the apparatus only outputs one of results within a predetermined range of variation, including "excellent luck", "small luck", etc., with certainty, and hence a user loses interest soon due to a decrease in the element of surprise. In addition, users are not tempted to purchase such an apparatus intended only for the above purposes for private use. However, even if the function of performing lottery, fortune-telling, or the like is added to the above-mentioned printing apparatus, the function is used only when the user expects to obtain one of such results as described above, and hence the function will hardly become a topic among users due to scarcity of the element of surprise.

SUMMARY OF THE INVENTION

It is a first object of the invention to provide a printing method and apparatus that is capable of adding an amusing effect and topicality resulting therefrom to printing personally performed by a user.

It is a second object of the invention to provide a label-producing method and apparatus that is capable of adding an amusing effect and topicality resulting therefrom to printing personally performed by a user.

To attain the above first object, according to a first aspect of the invention, there is provided a method of printing a desired image entered intentionally, on a printing medium, by a predetermined print instruction.

The method according to the first aspect of the invention is characterized by comprising the steps of:

issuing the predetermined print instruction; and when the predetermined print instruction is issued, printing the desired image, and if a predetermined condition which cannot be intentionally set by an instruction of a user is satisfied at the same time, also printing an unintended image which cannot be generated intentionally, together with the desired image.

To attain the above first object, according to a second aspect of the invention, there is provided a printing apparatus for printing a desired image entered intentionally, on a printing medium, by a predetermined print instruction.

The printing apparatus according to the second aspect of the invention is characterized by comprising:

print instruction means for issuing the predetermined print instruction; and printing means that when the predetermined print instruction is issued, prints the desired image, and if a predetermined condition which cannot be intentionally set by an instruction of a user is satisfied at the same time, also prints an unintended image which cannot be generated intentionally, together with the desired image.

The printing apparatus of the present invention, which basically performs printing of a desired image entered intentionally, on a printing medium, by a predetermined print instruction, is capable of printing not only a desired image but also an unintended image which cannot be printed intentionally by the user, if the predetermined condition which cannot be intentionally set by an instruction of a user is satisfied, when the predetermined print instruction is issued for printing of the desired image. In short, when the predetermined print instruction is issued and when the predetermined condition is satisfied, the apparatus prints the unintended image which cannot be printed intentionally, simultaneously with printing of the desired image, or before or after printing of the desired image after the predetermined print instruction. It should be noted that the term "unintended image" used here means an image which is printed randomly (accidentally) or with uncertainty. The user does not know about even the possibility of printing of the image, or even if he does, he cannot tell when the image will actually be printed. In short, the "unintended image" is an image which the user cannot print intentionally, or more specifically, an image which cannot be printed as desired or which is printed only under a predetermined condition which cannot be fulfilled as desired by instructing predetermined printing conditions.

Further, according to the printing method and apparatus of the invention, a desired image which the user originally intended to print is printed as planned, irrespective of whether or not the unintended image is printed. Therefore, while the user can print a desired image by issuing the predetermined print instruction, he is given a surprise when the unintended image is printed. If the user does not know about the possibility of printing of the unintended image, he will be surprised by the result of printing he did not expect. Even if he knows about it, he will, because it cannot be expected when the unintended printing will be carried out. In addition, the unintended printing could be an event which users aware of the possibility of printing of the unintended image look forward to, and hence if the printing happens to be carried out, the lucky accident is likely to become a topic among the users. Thus, the printing method and apparatus can add an amusing element and topicality resulting therefrom to printing personally performed by a user.

Preferably, the unintended image is an image which is difficult or impossible to generate intentionally as the desired image.

According to this preferred embodiment of each of the first and second aspects of the invention, the unintended image is an image which is very difficult or even impossible to generate intentionally. Therefore, the scarcity value of the unintended image is enhanced, and at the same time forgery of the image becomes difficult. Therefore, it is possible to use the portion of the printing medium printed with the unintended image e.g. as an exchange ticket (gift coupon) for a gift or prize, thereby adding further amusing and topical elements to printing personally performed by a user.

More preferably, the unintended image includes an image representative of numeric information based on an unintended code including at least one of an encrypted code obtained by encrypting information of the desired image to be printed together with the unintended image and a built-in code stored in a printing apparatus.

According to this preferred embodiment of each of the first and second aspects of the invention, since the unintended code including at least one of the encrypted code and the built-in code cannot be changed as desired by the user, intentional generation (forgery) of the unintended image becomes difficult and even impossible.

Preferably, the unintended code includes a check code which can be checked by a predetermined check method.

This preferred embodiment of each of the first and second aspects of the invention not only makes it still more difficult to generate (forge) the unintended image intentionally, but also makes it possible to detect forgery if any, and hence, when the unintended image is used for a gift coupon or the like, even a local dealer or sales agent can check whether the unintended image is authentic.

Further, preferably, the printing method according to the first aspect of the invention further comprises the step of generating a random number, and the predetermined condition includes a condition concerning the generated random number.

Similarly, the printing apparatus according to the second aspect of the invention further comprises random number-generating means for generating a random number, and the predetermined condition includes a condition concerning the generated random number.

According to these preferred embodiments, the predetermined condition includes a condition concerning the generated random number. Therefore, the predetermined condition is made random, thereby preventing users from setting it by an instruction, and expecting when it will be satisfied.

Preferably, the numeric information includes information indicative of a numeric value of the generated random number.

According to this preferred embodiment of each of the first and second aspects of the invention, since the numeric information includes information indicative of the numeric value of the random number, it is still more difficult to generate the unintended image intentionally.

More preferably, the method according to the first aspect of the invention further comprises the step of mounting a predetermined amount of the printing medium, and the predetermined condition includes information of an amount of a consumed or remaining portion of the printing medium.

Similarly, the printing apparatus according to the second aspect of the invention further comprises mounting means for mounting a predetermined amount of the printing medium, and the predetermined condition includes information of an amount of a consumed or remaining portion of the printing medium.

According to these preferred embodiments, the information of the amount of a consumed or remaining portion of the printing medium is included in the predetermined condition. Therefore, it is possible to increase or decrease the probability of satisfaction of the predetermined condition. This makes it easy to increase the variety of the amusing element and the resultant topicality of printing personally performed by a user, thereby contributing to sales promotion of printing mediums.

Preferably, the unintended image includes an image representative of the information of the amount of the consumed or remaining portion of the printing medium.

According to this preferred embodiment of each of the first and second aspects of the invention, an image representative of the information of the amount of the consumed or remaining portion of the printing medium is included in the unintended image. Therefore, it is still more difficult to generate the unintended image intentionally. Further, when the unintended image is used for a gift coupon or the like, a local dealer or sales agent can read the information and check it against dishonest generation (forgery) of the unintended image.

Preferably, the printing medium is a tape.

According to this preferred embodiment of each of the first and second aspects of the invention, a tape is used as the printing medium. Therefore, it is possible to apply the printing method and apparatus to a tape printing apparatus.

To attain the second object, according to a third aspect of the invention, there is provided a method of producing a label by printing a desired image entered intentionally, on a printing medium, by a predetermined print instruction.

The method according to the third aspect of the invention is characterized by comprising the steps of:

issuing the predetermined print instruction;

when the predetermined print instruction is issued, printing the desired image, and if a predetermined condition which cannot be intentionally set by an instruction of a user is satisfied at the same time, also printing an unintended image which cannot be generated intentionally, together with the desired image; and cutting off a portion of the printing medium printed with the unintended image after the printing of the unintended image, to thereby produce an unintended label printed with the unintended image.

To attain the second object, according to a fourth aspect of the invention, there is provided a label-producing apparatus for producing a label by printing a desired image entered intentionally, on a printing medium, by a predetermined print instruction.

The label-producing apparatus according to the fourth aspect of the invention is characterized by comprising:

print instruction means for issuing the predetermined print instruction;

printing means that when the predetermined print instruction is issued, prints the desired image, and if a predetermined condition which cannot be intentionally set by an instruction of a user is satisfied at the same time, also prints an unintended image which cannot be generated intentionally, together with the desired image; and cutter means for cutting off a portion of the printing medium printed with the unintended image after the printing of the unintended image, to thereby produce an unintended label printed with the unintended image.

According to this label-producing method and apparatus, the portion of the printing medium printed with the unintended image can be cut off after the printing. Therefore, it is easy to produce an unintended image label printed with the unintended image, and hence it is also easy to utilize the unintended image label e.g. as a gift coupon or the like which can be affixed to a postcard or the like and sent to the maker to exchange it for a gift or prize.

The above and other objects, features, and advantages of the invention will become more apparent from the following detailed description taken in conjunction with the accompanying drawings.

BRIEF DESCRIPTION OF THE DRAWINGS

FIGS. 9A and 9B are diagrams each illustrating an example of a lucky image label to be used as a gift coupon or the like.

DETAILED DESCRIPTION

The invention will now be described in detail with reference to the drawings showing a tape printing apparatus to which are applied a printing method and apparatus and a label-producing method and apparatus, according to an embodiment thereof.

Figure 1:
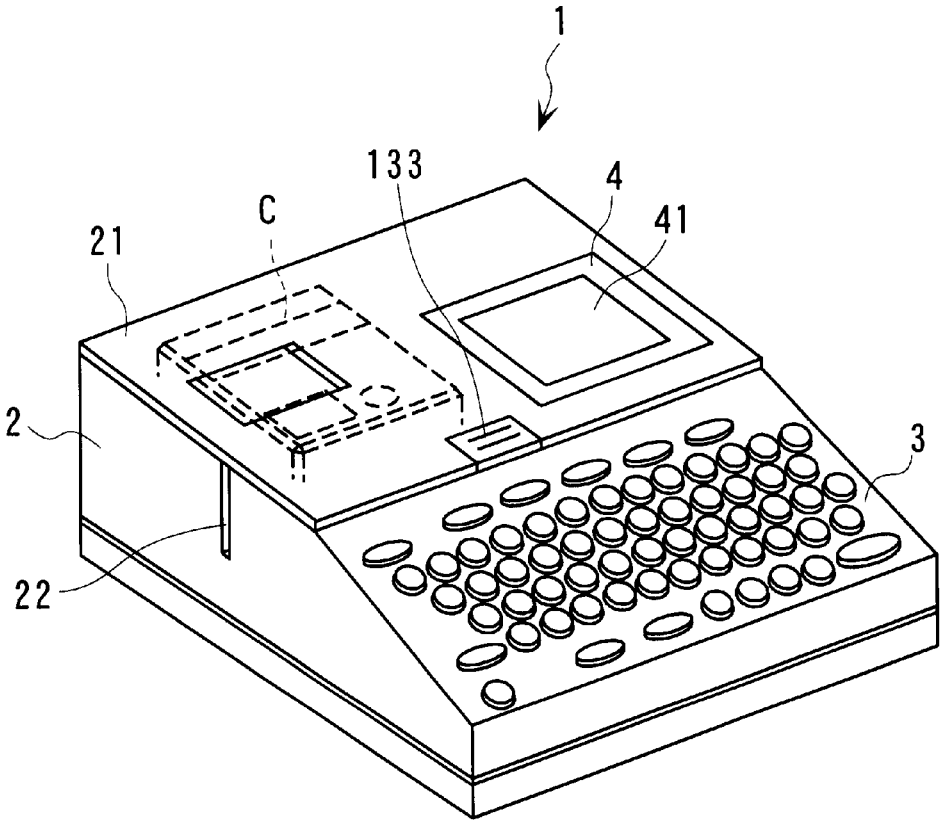
FIG. 1 is a perspective view of a tape printing apparatus to which are applied a printing method and apparatus as well as a label-producing method and apparatus according to an embodiment of the present invention.
Figure 2:
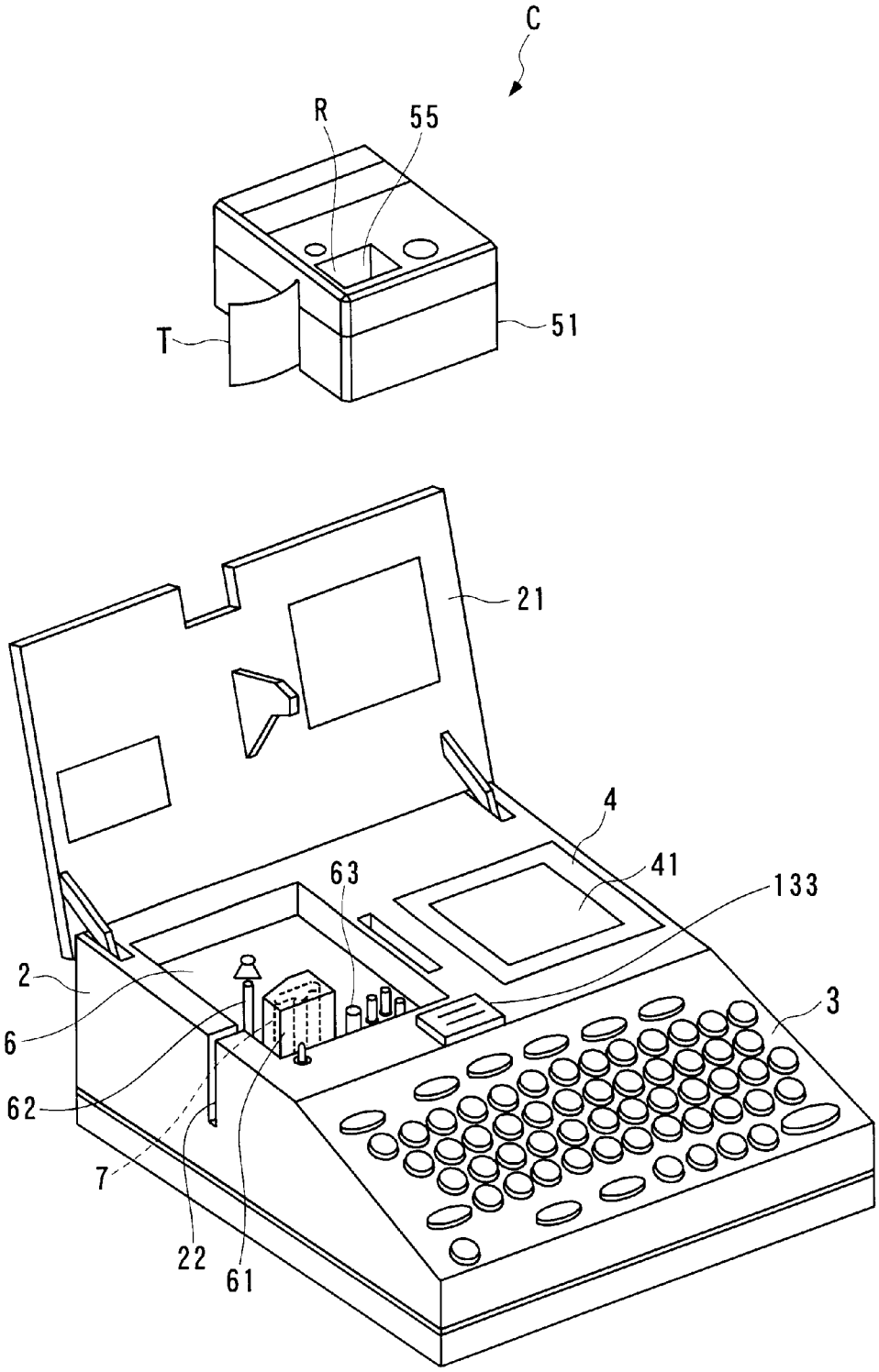
FIG. 2 is a perspective view showing the FIG. 1 tape printing apparatus with a lid thereof open.
Figure 3:
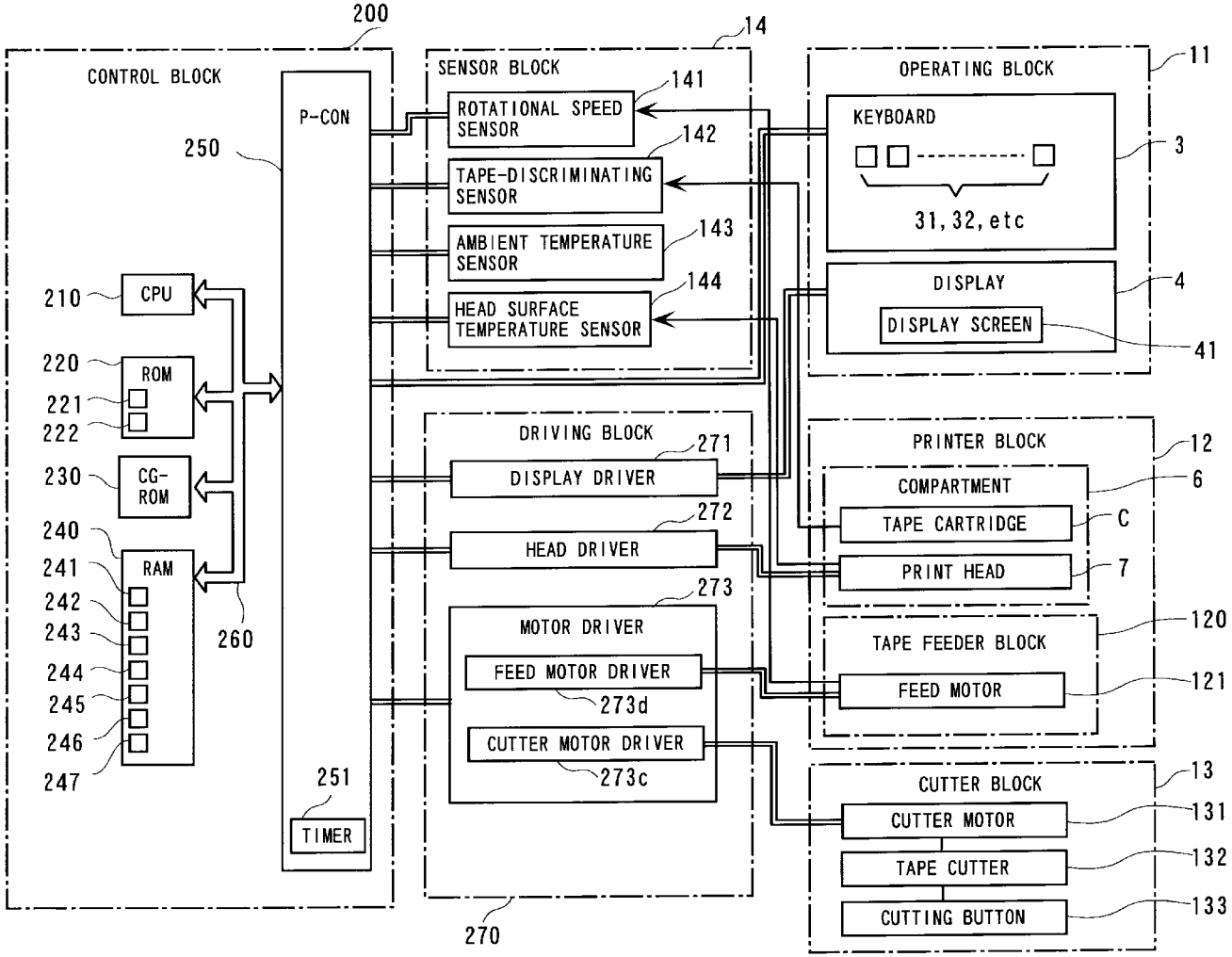
FIG. 3 is a block diagram schematically showing a control system of the FIG. 1 tape printing apparatus.

FIG. 1 is a perspective view of an appearance of the whole tape printing apparatus, and FIG. 2 is a perspective view of the FIG. 1 tape printing apparatus with its lid open. FIG. 3 is a block diagram schematically showing a control system of the FIG. 1 tape printing apparatus.

As shown in FIGS. 1 and 2, the tape printing apparatus 1 includes a casing 2 having upper and lower divisional portions. The casing 2 has a keyboard 3 arranged on the top of the front portion thereof, a lid 21 attached to the top of the rear portion thereof, and a display 4 arranged in a window formed in the right-hand side of the lid 21. The keyboard 3 is comprised of various kinds of entry keys.

Further, as shown in FIG. 3, the tape printing apparatus 1 is basically comprised of an operating block 11 having the keyboard 3 and the display 4 for interfacing with the user, a printer block 12 having a print head (thermal head) 7 and a tape feeder block 120 for printing on a printing tape (hereinafter simply referred to as "the tape") T unwound from a tape cartridge C mounted in a compartment 6, a cutter block 13 for cutting off a printed portion of the tape T, a sensor block 14 having various sensors for carrying out various detecting operations, a driving block 270 having drivers for driving circuits of blocks and devices, and a control block 200 for controlling operations of components of the tape printing apparatus 1 including the above-mentioned sensors and drivers. To implement the above construction, the casing 2 accommodates a circuit board, not shown, in addition to the printer block 12, the cutter block 13, the sensor block 14 and so forth. On the circuit board are mounted a power supply unit and the circuits of the driving block 270 and the control block 200. The circuit board is connected to a connector port for connecting an AC adapter thereto, and batteries, such as nicad batteries, which can be removably mounted within the casing 2 from outside.

In the tape printing apparatus 1, after mounting the tape cartridge C in the compartment 6, the user enters printing information, such as desired characters (letters, numerals, symbols, simple figures, etc.) via the keyboard 3, while confirming or viewing the results of the entry or edit of the printing information on the display 4. Thereafter, when the user instructs the apparatus 1 to perform a printing operation via the keyboard 3, the tape feeder block 120 unwinds a tape T from the tape cartridge C, while the print head 7 prints on the tape T. The printed portion of the tape T is delivered from a tape exit 22 as the printing proceeds. When the desired printing operation is completed, the tape feeder block 120 sends the tape T to a position corresponding to termination of a tape length (the length of a label to be formed) including the length of margins, and then stops the feeding of the tape.

As shown in FIGS. 2 and 3, the printer block 12 has the compartment 6 arranged under the lid 21 for mounting the tape cartridge C therein. The tape cartridge C can be mounted in or removed from the compartment 6 when the lid 21 is open. The tape cartridge C has a cartridge casing 51 holding a tape T having a predetermined width (approximately 4.5 to 48 mm) and an ink ribbon R. The tape cartridge C is formed with a through hole 55 for receiving therein a head unit 61 arranged in the compartment 6. Further, the tape cartridge C has a plurality of small holes formed in the bottom thereof for discrimination of a type of the tape T contained therein from the other types of the tape T having different widths, which are contained in other types of tape cartridges C. The compartment 6 has a tape-discriminating sensor 142 comprised of micro-switches or the like, for detecting the above holes to thereby determine the type of the tape T set for use.

The tape T has an adhesive surface on the reverse side which is covered with a peel-off paper. The tape T and the ink ribbon R are fed or run such that they pass by the through hole 55, in a state lying one upon the other, and the tape T alone is delivered out of the tape cartridge C, but the ink ribbon R is taken up into a roll within the tape cartridge C.

The head unit 61 contains the print head 7 formed of a thermal head. The print head 7 is brought into contact with the reverse side of the ink ribbon R exposed to the through hole 55 of the tape cartridge C when the tape cartridge C is mounted in the compartment 6 with the print head 7 fitted in the through hole 55. Then, by driving the print head 7 while heating the same, desired letters and the like are printed on the surface of the tape T. The compartment 6 is provided with an ambient temperature sensor 143, such as a thermistor, which sends information of an ambient temperature detected thereby to a control block 200.

Further, the casing 2 has a left side portion thereof formed with a tape exit 22 for causing the compartment 6 and the outside of the apparatus to communicate with each other. Opposed to the tape exit 22, there is arranged a tape cutter 132 for cutting off a dispensed portion of the tape T. Further, the compartment 6 is provided with drive shafts 62, 63 for engagement with driven portions of the tape cartridge 4 mounted in the compartment 6. A feed motor 121 as a drive source drives these drive shafts 62, 63 for rotation to cause the tape T and the ink ribbon R to be fed or advanced in the tape cartridge C, and at the same time the print head 7 is driven in synchronism with the feeding of the tape and ribbon to carry out printing. Further, after completion of the printing operation, the tape T continues to be fed to bring a predetermined cutting position (corresponding to the tape length) on the tape T to the position of the tape cutter 132.

It should be noted that a head surface temperature sensor 144 formed e.g. by a thermistor is arranged on a surface of the print head 7 in a manner intimately contacting the surface, which sends information of the surface temperature of the print head 7 detected thereby to the control block 200. The feed motor 121 has an end on which is rigidly fitted a disc, not shown, formed with detection openings, and a rotational speed sensor 141 including a photo sensor or the like is provided to face the path of the detection openings, for sending information of the rotational speed of the feed motor 121 detected thereby to the control block 200.

The cutter block 13 includes a tape cutter 132, a cutting button 133 for manual operation to cause the tape cutter 132 to cut the tape T when a desired length printing is carried out, for instance, and a cutter motor 131 for automatically driving the tape cutter 132 to cut the tape T when a fixed length printing is carried out, for instance. To selectively carry out one of the two cutting operations, the tape printing apparatus 1 is capable of being switched between a manual cutting mode and an automatic cutting mode according to a mode-setting operation. More specifically, in the manual cutting mode, when the printing operation is completed, the user pushes the cutting button 133 arranged on the casing 2, whereby the tape cutter 132 is actuated to cut the tape T to a desired length. On the other hand, in the automatic cutting mode, after completion of the printing operation, the tape T is sent for incremental feed by the length of a rear margin, and then stopped, whereupon the cutter motor 131 is driven to cut off the tape T.

The sensor block 14 includes the rotational speed sensor 141, the tape-discriminating sensor 142, the ambient temperature sensor 143 and the head surface temperature sensor 144. It should be noted that the above sensors can be omitted to suit the actual requirements of the tape printing apparatus.

The driving block 270 includes a display driver 271, a head driver 272, and a motor driver 273. The display driver 271 drives the display 4 of the operating block 11 in response to control signals delivered from the control block 200, i.e. in accordance with commands carried by the signals. Similarly, the head driver 272 drives the print head 7 of the printer block 12 in accordance with commands from the control block 200. Further, the motor driver 273 includes a feed motor driver **273*d* for driving the feed motor 121 of the printer block 12, and a cutter motor driver 273*c* for driving the cutter motor 131 of the cutter block 13, and similarly to the display driver 271 and the head driver 272, drives each motor in accordance with commands from the control block 200**.

The operating block 11 includes the keyboard 3 and the display 4. The display 4 has a display screen 41 which is capable of displaying display image data of 96×64 dots on a rectangular display area of approximately 6 cm in the horizontal direction (X direction)×4 cm in the vertical direction (Y direction). The display 4 is used by the user when he enters data, instructions or commands via the keyboard 3 to form or edit print image data, such as character string image data (i.e. text print data, referred to hereinafter), and check the result of the entry.

On the keyboard 3, there are arranged a character key group 31 including an alphabet key group, a symbol key group, a number key group, and a nonstandard character key group for calling nonstandard characters for selection, as well as a function key group 32 for designating various operation modes. In a type of the apparatus which is capable of entering the Japanese language, there is also provided a kana key group for entering Japanese hiragana letters and Japanese katakana letters.

The function key group 32 includes a power key, not shown, a print key, not shown, for instructing the apparatus 1 to perform a printing operation, a selection key, not shown, for finally determining entry of character data and feeding lines during text entry as well as determining selection of one of modes on a selection screen, a decoration-setting key, not shown, for setting a decoration, such as a so-called character decoration e.g. by hatching, underlining, boxing, etc. or a background decoration (including a background pattern, an illustration and the like), a color-setting key, not shown, for setting colors (including gray levels, color saturation, luster, transparency, and so forth) of characters, a background and a decoration, and four cursor keys (up arrow key, down arrow key, left arrow key, and right arrow key), not shown, for moving the cursor or the display range of print image data on the display screen 41 in respective upward, downward, leftward, and rightward directions.

The function key group 32 also includes a cancel key, not shown, for canceling instructions, a shift key, not shown, for use in changing roles of respective keys as well as modifying registered image data, an image key, not shown, for alternately switching between a text entry screen or a selection screen and a display screen (image screen) for displaying print image data, a proportion-changing (zoom) key, not shown, for changing a proportion between the size of a print image and the size of a display image displayed on the image screen, and a form key, not shown, for setting formats, including a typeface, of labels to be formed.

Similarly to keyboards of the general type, the above key entries may be made by separate keys exclusively provided therefor or by a smaller number of keys operated in combination with the shift key and/or the like. Here, for purposes of ease of understanding, the following description will be made assuming that there are provided as many keys as described above. As shown in FIG. 3, from the keyboard 3, various commands described above and data are input to the control block 200.

The control block 200 includes a CPU 210, a ROM 220, a character generator ROM (CG-ROM) 230, a RAM 240, a peripheral control circuit (P-CON) 250, all of which are connected to each other by an internal bus 260.

The ROM 220 has a control program area 221 for storing control programs executed by the CPU 210 as well as a control data area 222 for storing control data including a color conversion table, a character modification table and the like.

The CG-ROM 230 stores font data, i.e. data defining characters, symbols, figures and the like, provided for the tape printing apparatus 1. When code data for identifying a character or the like is input thereto, it outputs the corresponding font data.

The RAM 240 is supplied with power by a backup circuit, not shown, such that stored data can be preserved even when the power is turned off by operating the power key. The RAM 240 includes areas of a register group 241, a text data area 242 for storing text data of letters or the like entered by the user via the keyboard 3, a display image data area 243 for storing image data displayed on the display screen 41, a print image data area 244 for storing print image data, a registered image data area 245 for storing registered image data, as well as a print record data area 246 and conversion buffer areas 247 including a color conversion buffer. The RAM 240 is used as a work area for carrying out the control process.

The P-CON 250 incorporates a logic circuit for complementing the functions of the CPU 210 as well as dealing with interface signals for interfacing between the CPU 210 and peripheral circuits. The logic circuit is implemented by gate arrays, a custom LSI and the like. For instance, a timer 251 is incorporated in the P-CON 250 for the function of measuring elapsed time. Accordingly, the P-CON 250 is connected to the sensors of the sensor block 14 and the keyboard 3, for receiving the above-mentioned signals generated by the sensor block 14 as well as commands and data entered via the keyboard 3, and inputting these to the internal bus 260 directly or after processing them. Further, the P-CON 250 cooperates with the CPU 210 to output data and control signals input to the internal bus 260 by the CPU 210 or the like, to the driving block 270 directly or after processing them.

The CPU 210 of the control block 200 receives the signals from the sensor block 14, and the commands and data input via the keyboard 3 via the P-CON 250, according to the control program read from the ROM 220, processes font data from the CG-ROM 230 and various data stored in the RAM 240, and delivers control signals to the driving block 270 via the P-CON 250 to thereby carry out position control during printing operations, display control of the display screen 41, and printing control of the print head 7 to carry out printing on the tape T under predetermined printing conditions. In short, the CPU 210 controls the overall operation of the tape printing apparatus 1.

Next, the overall control process carried out by the tape printing apparatus 1 will be described with reference to FIG. 4. As shown in the figure, when the program for carrying out the control process is started e.g. when the power of the tape printing apparatus 1 is turned on, first, at a step S1, initialization of the system including restoration of saved control flags is carried out to restore the tape printing apparatus 1 to the state it was in before the power was turned off the last time. Then, the image that was displayed on the display screen 41 before the power was turned off the last time is shown as an initial screen at a step S2.

Figure 4:
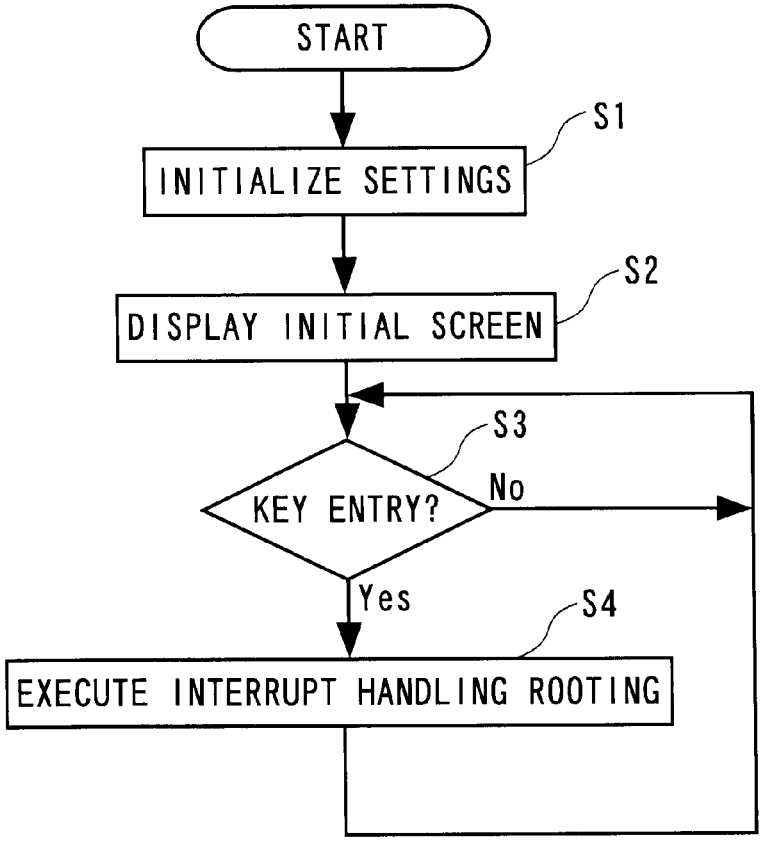
FIG. 4 is a flowchart showing an overall control process executed by the FIG. 1 tape printing apparatus.

The following steps in FIG. 4, that is, a step S3 for determining whether or not a key entry has been made and a step S4 for carrying out an interrupt handling operation are conceptual representations of actual operations. Actually, when the initial screen has been displayed at the step S2, the tape printing apparatus 1 enables an interrupt by key entry (keyboard interrupt), and maintains the key entry wait state (No to S3) until a keyboard interrupt is generated. When the keyboard interrupt is generated (Yes to S3), a corresponding interrupt handling routine is executed at the step S4, and after the interrupt handling routine is terminated, the key entry wait state is again enabled and maintained (No to S3).

As described above, in the tape printing apparatus 1, main processing operations by the apparatus are carried out by interrupt handling routines, and hence, by depressing the print key at a desired time, a print interrupt is generated to start a printing process, whereby the user can print a print image (a character string image, a lucky print image, or the like) based on print image data (text print data, lucky print data, or the like) at the desired time point. In short, operating procedures up to the printing operation can be selectively carried out by the user as he desires.

In the following, description will be made of an example of a printing operation performed for printing a "lucky image" (unintended image) when predetermined conditions including a condition that "the length (print length) of a character string image to be printed exceeds a predetermined value", i.e. "the length (text length) of text data corresponding to a character string image to be printed exceeds a predetermined value (text length>predetermined value)" are satisfied. The predetermined condition can be defined by setting the predetermined value based on a result of detection by the tape-discriminating sensor 142, for instance, such that the print length exceeds 4 cm (predetermined value=4 cm) when a tape T (i.e. a printing tape T) contained in a tape cartridge C has a width of 6 mm, or that the print length exceeds 8 cm (predetermined value=8 cm) when the tape width is 24 mm.

Other predetermined conditions explained below also include a condition based on random number generation. This condition is satisfied e.g. when nine digits of a 9-digit numeric number (nine digit hexadecimal number: 36 bits) generated as a random number are all even numbers or, more limitedly, when the generated random number is equal to one of a plurality of predetermined numeric values. It should be noted that probability of satisfaction of this condition may also be varied with the tape width. For instance, the probability may be set to $1/10000$ when the tape width is 6 mm, and $2/10000$ when the tape width is 24 m.

Figure 5:
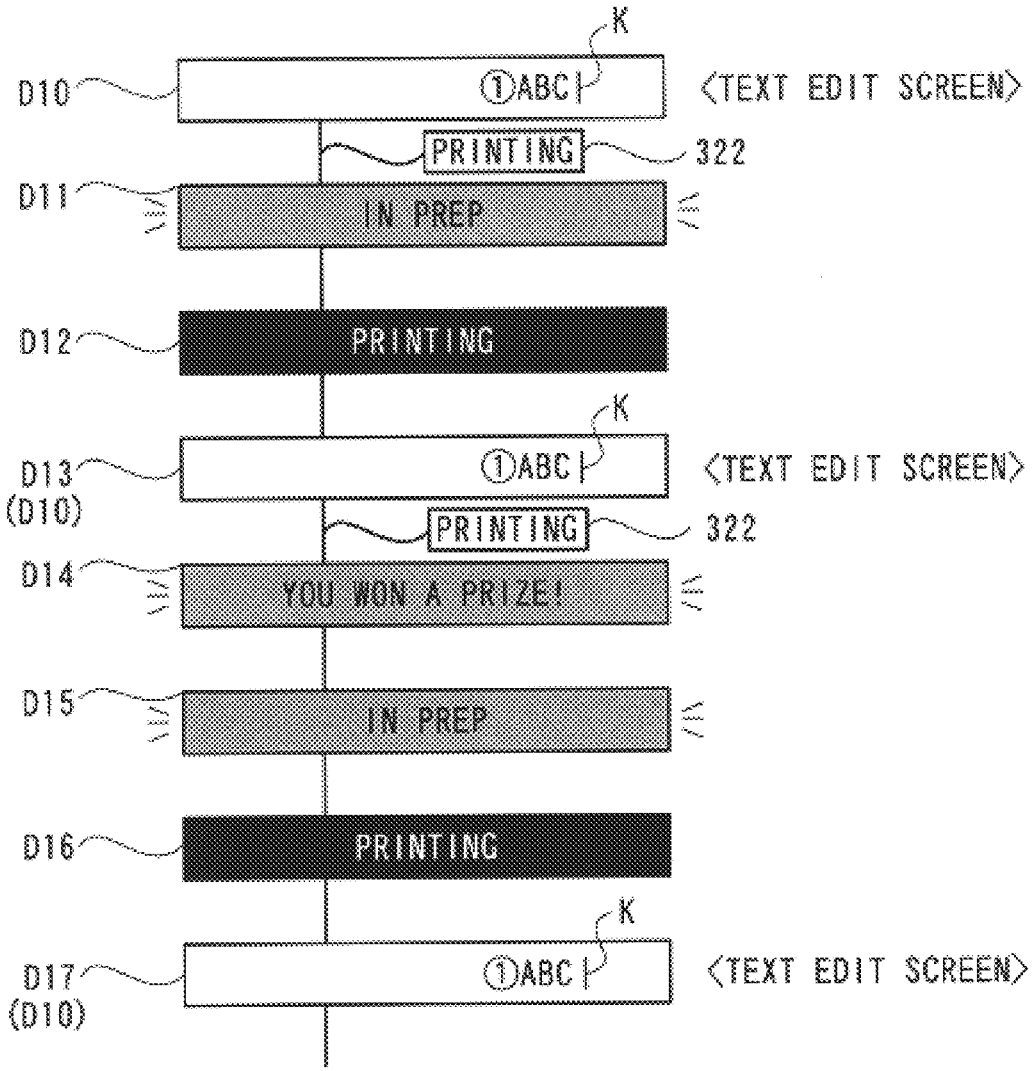
FIG. 5 is a diagram schematically illustrating examples of a display screen and an operating procedure carried out on the display screen, which is useful in explaining text printing and lucky printing.
Figure 6:
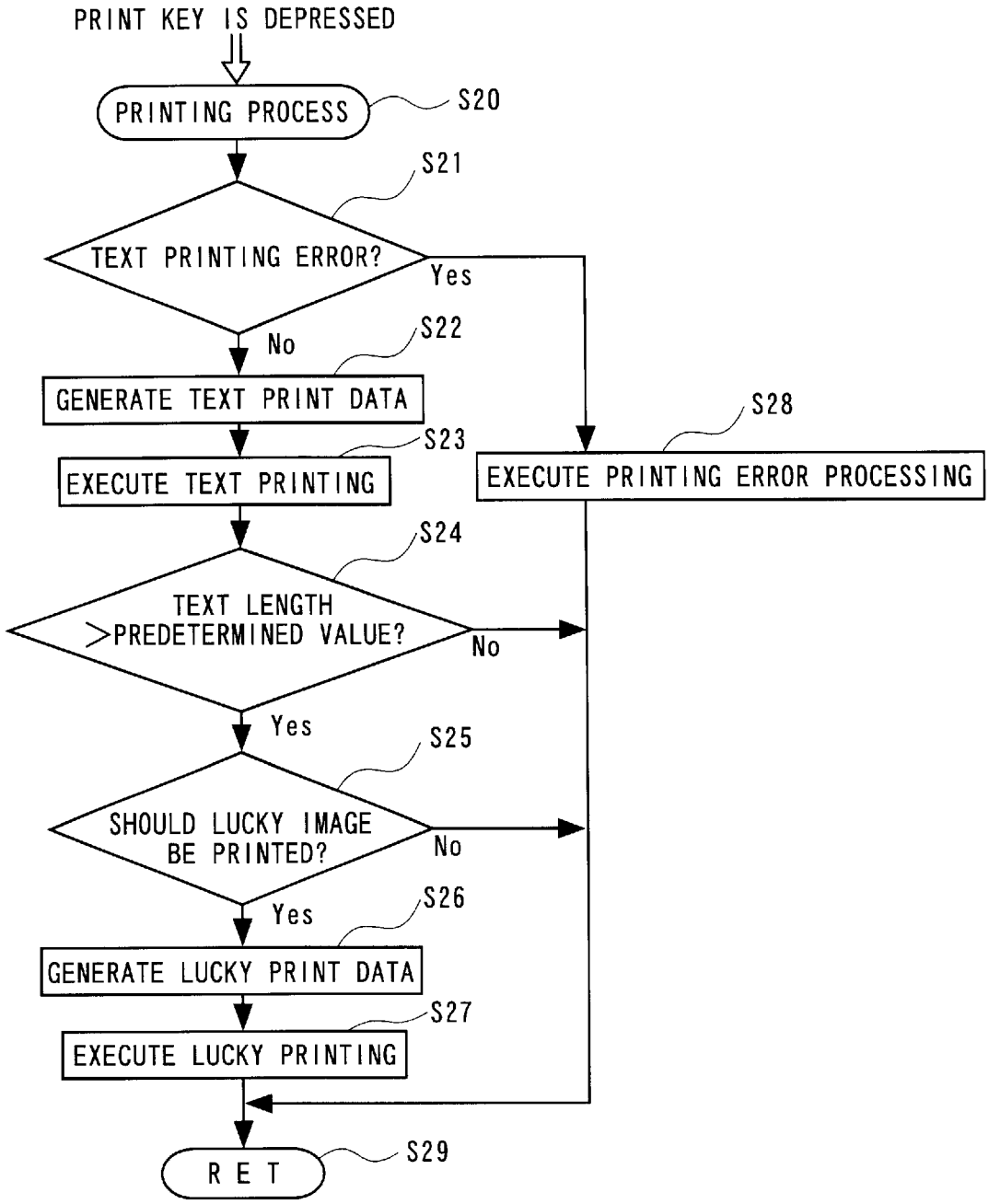
FIG. 6 is a flowchart showing a typical example of a printing process.

Now, detailed description will be made with reference to FIGS. 5 et seq. For instance, when the print key is depressed by the user, as shown in FIGS. 5 and 6, in a state of a text edit screen [screen D10: hereinafter, contents displayed on the screen (display area) of the display screen 41 are referred to as the "screen D??" (? represents a digit), and indicated only by D?? in FIG. 5 as well as in the following description, with a cursor position being indicated by a symbol K] being displayed, a print key interrupt is generated to start the printing process (S20). Then, it is determined at a step S21 whether or not there is any problem, such as absence of a tape cartridge C, an insufficient width of a tape with respect to a character string image to be printed, or the like, which hinders the start of a text printing operation, i.e. whether or not there has occurred a text printing error. If an error has occurred (Yes to S21), printing error processing is carried out at step S28 e.g. by displaying an error message to notify the user of the fact, followed by the printing process (S20) being terminated at a step S29.

On the other hand, if there is no error (No to S21), a message "IN PREP!" representing that preparation for printing is being made is displayed in a flashing manner (D11), and at the same time text data (e.g. "ABC" in FIG. 5) is read from the text data area 242 (see FIG. 3) of the RAM 240 storing the same and image data thereof is formed in the print image data area 244, based on corresponding font data from the CG-ROM 230. More specifically, at a step S22, text print data is generated as print image data representative of the character string image ("ABC" in FIG. 5). Then, at a step S23, a message "PRINTING!" representing that printing is being carried out is displayed in reverse video, i.e. in a highlighted manner (D12), and at the same time the character string image ("ABC") is printed on the tape T unwound from the tape cartridge C. In short, text printing is executed at a step S23.

When the text printing (S23) is completed, it is determined at the following step S24 whether or not the condition "text length>predetermined value", which is one of the aforementioned predetermined conditions, is satisfied. If the condition "text length>predetermined value" is satisfied (Yes to S24), it is determined at step S25 whether or not the other condition (e.g. the condition based on random number generation) included in the aforementioned predetermined conditions is satisfied, i.e. whether or not the lucky image "YOU WON A PRIZE!" should be printed. If at least one of the predetermined conditions is not satisfied, i.e. if the lucky image "YOU WON A PRIZE" should not be printed (No to S24 or S25), the printing process (S20) is terminated immediately at step S20, followed by the display screen returning to the original text edit screen (D13: the same as D10).

On the other hand, if the predetermined conditions are all satisfied, i.e. if the lucky image "YOU WON A PRIZE" should be printed (Yes to S24 and S25), the text data of "YOU WON A PRIZE" and image data of a special illustration, referred to hereinafter, and the like provided in advance in the control data area 222 (see FIG. 3) of the ROM 220 are read and formed in the print image data area 244. That is, lucky print data is formed at a step S26 as print image data representative of the "lucky image" (unintended image). Then, the lucky image based on the lucky print data is printed on the tape T, i.e. lucky printing is carried out at a step S27, followed by terminating the process.

In the above FIG. 6 flow of operations, for purposes of ease of understanding, the respective determinations as to whether the predetermined conditions for the lucky printing are satisfied are sequentially carried out at the steps S24 and S25. Actually, however, immediately after the start of the printing process (S20), the error determination (S20) and the determinations as to whether the predetermined conditions are satisfied are carried out simultaneously, and as a result, one of predetermined flags is set such that the printing process is executed following a procedure of operations determined differently depending on the flag. For instance, (1) when an error has occurred, the printing process is terminated (S29) after completion of the printing error processing (S28); (2) when no error has occurred and when the predetermined conditions are not satisfied, the printing process is terminated (S29) after the print text data generation (S22) and the text printing (S23) are executed and completed; and (3) when no error has occurred and when the predetermined conditions are satisfied, the printing process is terminated (S29) after the print text data generation (S22), the text printing (S23), the lucky print data generation (S26), and the lucky printing (S27) are all executed and completed.

Therefore, when the print key is depressed by the user in the state of the text edit screen (D13) being displayed, for generation of the print key interrupt to start the printing process (S20), and when it is determined immediately after the start of the printing process (S20) that no error has occurred and the predetermined conditions are satisfied (the case (3) mentioned above), i.e. when the lucky image "YOU WON A PRIZE" should be printed, first, the notification of the fact is displayed in a flashing manner (D14), and after the lapse of a predetermined time period, the massage "IN PREP!" representing that preparation for printing is being made is displayed in a flashing manner (D11), and the same time the text print data is generated. Subsequently, the message "PRINTING!" representing that printing is being performed is displayed in reverse video, i.e. in a highlighted manner (D12), and at the same time the text printing is performed. In parallel with the text printing, the lucky print data is generated, and immediately after completion of the text printing, the lucky printing is carried out. Then, upon completion of all these printing operations, the display screen returns to the original text edit screen (D17: the same as D10).

As described above, the tape printing apparatus 1, basically performs printing of a desired image entered via the keyboard as desired on a tape (printing medium) in response to depression of the print key (predetermined print instruction). However, when the print key is depressed (i.e. the predetermined print instruction is issued) for printing of the desired image, if the predetermined conditions which can neither intentionally be set by instructions nor be expected to be satisfied are satisfied, the tape printing apparatus 1 prints not only a desired image but also the lucky image (unintended image) which cannot be printed intentionally by the user. In short, when the print key is depressed and when the predetermined conditions are satisfied, the apparatus 1 prints the unintended image which cannot be printed intentionally, together with a desired image.

Figure 7A:
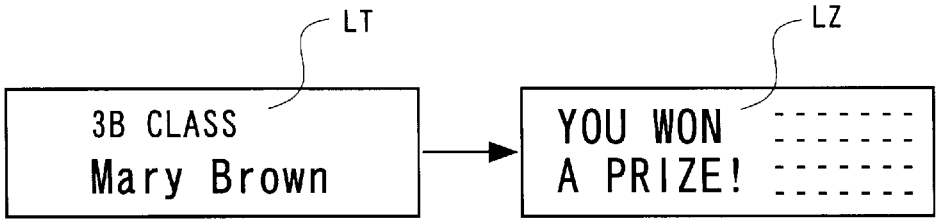
FIGS. 7A and 7B are diagrams illustrating an example of a character string image printed by text printing and a character string image label printed with the character string image as well as an example of a lucky image printed by lucky printing and a lucky image label printed with the lucky image, which are useful in explaining procedures of producing the two labels.
Figure 7B:
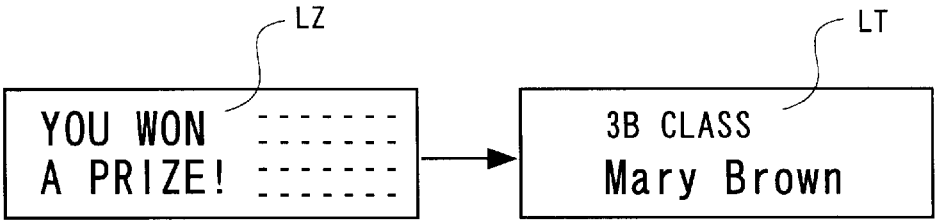

The phrase "together with a desired image" used here means "simultaneously with printing of the desired image, or before or after printing of the desired image after the predetermined print instruction". For instance, as shown in FIGS. 7A, 7B, when a character string image "3B CLASS" is to be printed on the first line, and another character string image "Mary Brown" on the second line as a desired image and when the lucky image is to be printed together with the character string images, the text printing of the character string images may be carried out (and the printed portion of the tape may be cut off to produce a character string image label LT), and then the lucky printing may be carried out (and the printed portion of the tape may be cut off to produce a lucky image label LZ) as shown in FIG. 7A, or the two printing operations may be carried out in a reverse order as shown in FIG. 7B. Further, when a tape having a sufficient width is used, it is possible to print a character string image and the lucky image on the tape simultaneously in parallel with each other along the direction of the lines of characters and then cut the printed portion of the tape in two in a manner separating the two images from each other, to thereby produce the character string image label LT and the lucky image label LZ simultaneously.

The lucky image in the above example is an unintended image are defined in the present invention, and the lucky image label (unintended image label) produced by printing the lucky image on a tape can be used as a kind of gift coupon. For example, the user may affix the label to a postcard and send it to a maker or alternatively hand the label directly to a local dealer or sales agent, so as to exchange it for a gift or prize (goods or service of a kind). In the tape printing apparatus 1, a portion of a tape printed with the lucky image can be cut off after the printing, so that it is easy to produce a lucky image label printed with the lucky image, which facilitates the above-mentioned utilization of the label as a gift coupon or the like.

The term "unintended image" used here means an image which is printed randomly (accidentally) or with uncertainty. The user cannot even tell the possibility of the unintended image being printed, or even if the user knows about the possibility, he cannot tell when the image will actually be printed. In short, the "unintended image" is an image which the user cannot print intentionally. Therefore, the image cannot be printed as desired or under predetermined conditions arbitrarily specified for printing. Further, it is impossible to expect when predetermined conditions for printing the "unintended image" will be satisfied. As described specifically hereinabove, in the present embodiment, the predetermined conditions for printing the "unintended image" include the condition based on random number generation. For this reason, the predetermined conditions contain randomness, and hence it is impossible to specify the conditions as desired or to expect when they will be satisfied.

Further, in the present embodiment, a desired image which the user originally intended to print is printed as planned, irrespective of whether or not the unintended image is printed. Therefore, while the user can print a desired image by issuing the predetermined print instruction, he is given a surprise when the unintended image happens to be printed. If the user does not know about the possibility of the unintended printing being effected, he is sure to be astonished by the unexpected result itself. Even if he knows about it, he will, because it cannot be expected when the unintended printing will be carried out. In addition, the unintended printing can be an event which users who know about the possibility of the unintended image being printed look forward to, and hence if the printing happens to be carried out, the lucky accident is likely to become a topic among the users. Thus, the tape printing apparatus 1 can add an amusing element and topicality resulting therefrom to printing personally performed by a user. In this connection, in order to prevent the user from considering execution of an unintended printing as an abnormal operation of the apparatus and stopping it, it is possible to display a message, such as "LUCKY PRINTING! DON'T STOP IT!" on the display screen during execution of the lucky printing.

Another advantage of the tape printing apparatus 1 is that a tape T is mounted in the apparatus in a state contained in a tape cartridge C. Accordingly, the tape printing apparatus 1 has a predetermined amount of tape T mounted therein as a printing medium. Therefore, the predetermined conditions for printing the unintended image may include conditions based on the length of the tape T to be consumed for the present printing, the total length of the tape T consumed so far, or the remaining length of the tape T after the present printing. For instance, the aforementioned condition that "text length>predetermined value" holds is an example where the length of the tape T to be consumed for the present printing is adopted as one of the predetermined conditions. If the information of tape consumption or remaining tape is thus included in the predetermined conditions, it is possible to increase or decrease the probability of satisfaction of the predetermined conditions. This makes it easy to increase the variety of the amusing element and the topicality of printing personally performed by a user, thereby contributing to sales promotion or the like of printing mediums.

In this case, it is preferred that the unintended image includes an image representative of the information of tape consumption or remaining tape. This makes it more difficult to generate the unintended image intentionally. Further, when the unintended image is used for a gift coupon or the like, a local dealer or sales agent can read the information and check it against dishonest generation (forgery) of the unintended image.

Moreover, it is preferable that the lucky image (unintended image) is an image which is very difficult or even impossible to generate intentionally. This difficulty or impossibility enhances the scarcity value of the unintended image and prevents forgery of the image, thereby allowing the portion of a tape printed with the image to be used properly as a gift coupon or the like and adding further amusing and topicality to the printing personally performed by a user.

Figure 8A:
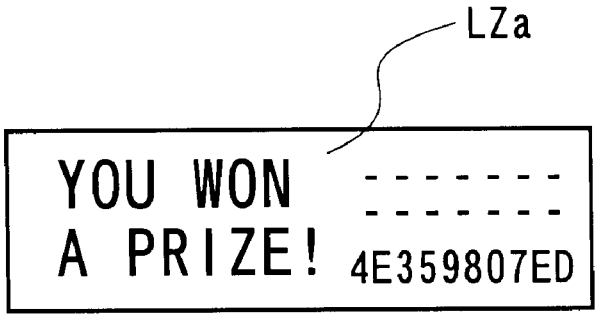
FIGS. 8A to 8C are diagrams each illustrating an example of a lucky image label which is difficult to produce as a desired image label.
Figure 8B:
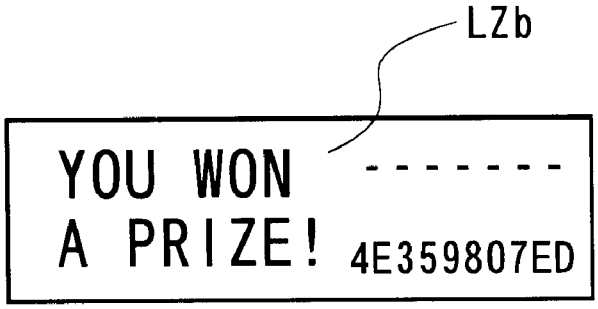

In this preferred embodiment, the lucky image may include an image (e.g. an image of ten digit hexadecimal number "4E359807ED" including a checksum, as illustrated in FIGS. 8A, 8B) representative of numeric information based on an encrypted code obtained by encrypting the information of a desired image (e.g. the character string images "3B CLASS" and "MaryBrown" in FIGS. 7A, 7B) to be printed together with the lucky image, following a predetermined rule. For instance, as shown in FIG. 8A, the image representative of the numeric information concerning the desired image may be printed as a portion of a lucky image (unintended image) label LZa.

Alternatively, the added unintended image may be an image representative of numeric information based on a code stored in a ROM or the like of each tape printing apparatus 1 and specific to the tape printing apparatus 1 (and secret even to the user). Anyway, since these encrypted code and built-in code are codes (unintended codes) each of which the user cannot change, a lucky image incorporating the image representative of numeric information based on any of the unintended codes of the above-mentioned kinds can be formed as an unintended image difficult and even impossible to generate (forge) intentionally.

Further, in this case, similarly to the above example, it is preferred that the unintended code includes a check code which can be checked by a predetermined check method. This not only makes it still more difficult to generate (forge) the unintended image intentionally, but also makes it possible to detect forgery if any, and hence, when the unintended image is used for a gift coupon or the like, the local dealer or sales agent can check it against dishonest production of the label. As the check method, it is possible to adopt the even/odd parity check, the modulo-3 check, the identity check (performed based e.g. on the identity between two bits positioned in an axisymmetrical or point-symmetrical manner) or the like in addition to the method of the above-mentioned type using a checksum.

Further, the numeric information may include the numeric value of a generated random number. In this case, the use of the random number makes it still more difficult to generate the unintended image intentionally. The random number used here may be generated as a specific one, or alternatively, the aforementioned random number as one of the predetermined conditions may be used. In the latter case, for example, it is checked whether or not the random number of the numeric information satisfies the one of the predetermined conditions which concerns the aforementioned random number.

Figure 8C:
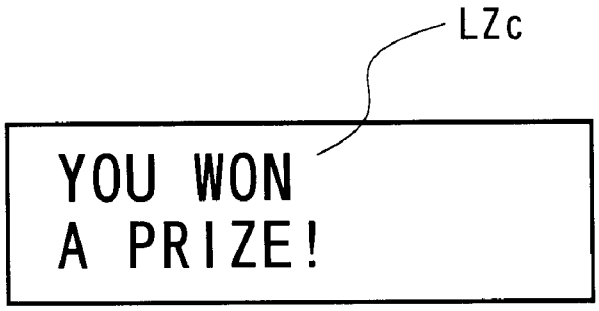

Further, for convenience of use as a gift coupon or the like, it is possible to encode the numeric information as a bar code and produce a lucky image label LZb printed with the bar code as shown in FIG. 8B so that a local dealer or sales agent can read it easily. Moreover, if the label LZb is also printed with a checksum, it is possible to determine automatically whether or not the label LZb is authentic, based on the read information. Furthermore, as shown in FIG. 8C, a special illustration, such as a picture, a symbol, or the like, which cannot be printed by a normal operation, may be utilized as an image which cannot be generated intentionally, to produce a lucky image label LZc.

Figure 9A:
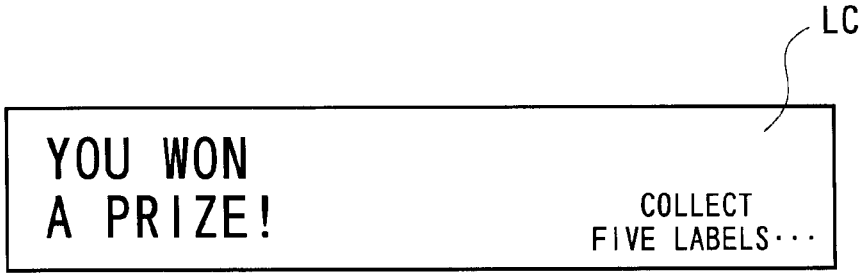
Figure 9B:
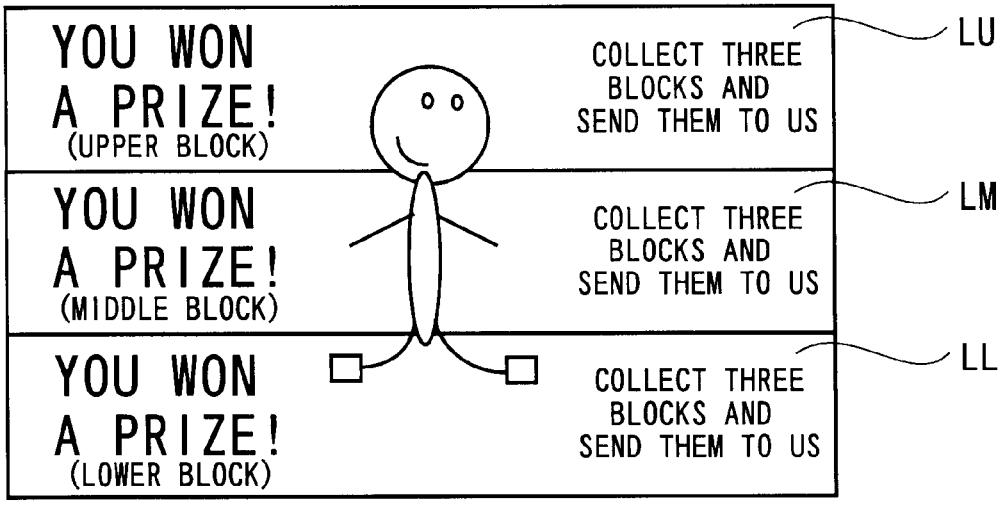

Further, when the use of the lucky image label as a gift coupon or the like is considered, the label may be regarded as valid only when a predetermined number of them are collected, as shown in FIGS. 9A, 9B. In this case, since a plurality of labels form one set, it is possible to enhance the user's interest by slightly increasing the probability of printing of the lucky image. The labels may be collected as a set formed by a plurality (five in the present embodiment) of lucky image labels LC of the same kind as shown in FIG. 9A or alternatively as one formed by a plurality (three in the present embodiment) of different kinds of lucky image labels, such as labels LU, LM, LL shown in FIG. 9B, which are combined to form a whole lucky image. In the latter case, variations may be provided according to the width of a tape to be used for printing. For instance, when a tape having a width of 6 mm is used, a lucky image may be completely formed by a set of three labels as shown in FIG. 9B, while when a tape having a width of 24 mm is used, the lucky image may be completely formed by a single label.

It is further understood by those skilled in the art that the foregoing are preferred embodiments of the invention, and that various changes and modifications may be made without departing from the spirit and scope thereof.

What is claimed is:

1. A method of printing a desired image entered intentionally, on a printing medium, by a predetermined print instruction, the method comprising the steps of:

issuing said predetermined print instruction; and when said predetermined print instruction is issued, printing said desired image, and if a predetermined condition which cannot be intentionally set by an instruction of a user is satisfied at the same time, also printing an unintended image which cannot be generated intentionally, together with said desired image.

2. A method according to claim 1, wherein said unintended image is an image which is difficult or impossible to generate intentionally as said desired image.

3. A method according to claim 1, wherein said unintended image includes an image representative of numeric information based on an unintended code including at least one of an encrypted code obtained by encrypting information of said desired image to be printed together with said unintended image and a built-in code stored in a printing apparatus.

4. A method according to claim 3, wherein said unintended code includes a check code which can be checked by a predetermined check method.

5. A method according to claim 1, further comprising the step of generating a random number, wherein said predetermined condition includes a condition concerning said generated random number.

6. A method according to claim 3, further comprising the step of generating a random number, wherein said predetermined condition includes a condition concerning said generated random number.

7. A method according to claim 6, wherein said numeric information includes information indicative of a numeric value of said generated random number.

8. A method according to claim 1, further comprising the step of mounting a predetermined amount of said printing medium, wherein said predetermined condition includes information of an amount of a consumed or remaining portion of said printing medium.

9. A method according to claim 8, wherein said unintended image includes an image representative of said information of said amount of said consumed or remaining portion of said printing medium.

10. A method according to claim 1, wherein said printing medium is a tape.

11. A method of producing a label by printing a desired image entered intentionally, on a printing medium, by a predetermined print instruction, comprising the steps of:

issuing said predetermined print instruction;

when said predetermined print instruction is issued, printing said desired image, and if a predetermined condition which cannot be intentionally set by an instruction of a user is satisfied at the same time, also printing an unintended image which cannot be generated intentionally, together with said desired image; and cutting off a portion of said printing medium printed with said unintended image after said printing of said unintended image, to thereby produce an unintended label printed with said unintended image.

12. A printing apparatus for printing a desired image entered intentionally, on a printing medium, by a predetermined print instruction, the printing apparatus comprising:

print instruction means for issuing said predetermined print instruction; and printing means that when said predetermined print instruction is issued, prints said desired image, and if a predetermined condition which cannot be intentionally set by an instruction of a user is satisfied at the same time, also prints an unintended image which cannot be generated intentionally, together with said desired image.

13. A printing apparatus according to claim 12, wherein said unintended image is an image which is difficult or impossible to generate intentionally as said desired image.

14. A printing apparatus according to claim 12, wherein said unintended image includes an image representative of numeric information based on an unintended code including at least one of an encrypted code obtained by encrypting information of said desired image to be printed together with said unintended image and a built-in code stored in the printing apparatus.

15. A printing apparatus according to claim 14, wherein said unintended code includes a check code which can be checked by a predetermined check method.

16. A printing apparatus according to claim 12, further comprising random number-generating means for generating a random number, wherein said predetermined condition includes a condition concerning said generated random number.

17. A printing apparatus according to claim 14, further comprising random number-generating means for generating a random number, wherein said predetermined condition includes a condition concerning said generated random number.

18. A printing apparatus according to claim 17, wherein said numeric information includes information indicative of a numeric value of said generated random number.

19. A printing apparatus according to claim 12, further comprising mounting means for mounting a predetermined amount of said printing medium in the printing apparatus, wherein said predetermined condition includes information of an amount of a consumed or remaining portion of said printing medium.

20. A printing apparatus according to claim 19, wherein said unintended image includes an image representative of said information of said amount of said consumed or remaining portion of said printing medium.

21. A printing apparatus according to claim 12, wherein said printing medium is a tape.

22. A label-producing apparatus for producing a label by printing a desired image entered intentionally, on a printing medium, by a predetermined print instruction, the label-producing apparatus comprising:

print instruction means for issuing said predetermined print instruction;

printing means that when said predetermined print instruction is issued, prints said desired image, and if a predetermined condition which cannot be intentionally set by an instruction of a user is satisfied at the same time, also prints an unintended image which cannot be generated intentionally, together with said desired image; and cutter means for cutting off a portion of said printing medium printed with said unintended image after said printing of said unintended image, to thereby produce an unintended label printed with said unintended image.

* * * * *